US012240576B2

(12) United States Patent
Rabena et al.

(10) Patent No.: US 12,240,576 B2
(45) Date of Patent: Mar. 4, 2025

(54) PERSON OVERBOARD RETRIEVAL APPARATUS

(71) Applicant: Diverse Marine Safety Group, LLC, Virginia Beach, VA (US)

(72) Inventors: Frank Rabena, Virginia Beach, VA (US); Jerry Ryan Bryant, Virginia Beach, VA (US); William Saunders, Suffolk, VA (US); Jacob Johnson, Suffolk, VA (US)

(73) Assignee: Diverse Marine Safety Group, LLC, Virginia Beach, VA (US)

( * ) Notice: Subject to any disclaimer, the term of this patent is extended or adjusted under 35 U.S.C. 154(b) by 191 days.

(21) Appl. No.: 17/975,124

(22) Filed: Oct. 27, 2022

(65) Prior Publication Data

US 2023/0117333 A1 Apr. 20, 2023

Related U.S. Application Data

(63) Continuation of application No. PCT/US2022/046512, filed on Oct. 13, 2022.

(60) Provisional application No. 63/308,624, filed on Feb. 10, 2022, provisional application No. 63/256,064, filed on Oct. 15, 2021.

(51) Int. Cl.
*B63C 9/26* (2006.01)

(52) U.S. Cl.
CPC ..... *B63C 9/26* (2013.01); *B63C 2009/265* (2013.01)

(58) Field of Classification Search
CPC ..... B63C 9/26; B63C 2009/265
See application file for complete search history.

(56) References Cited

U.S. PATENT DOCUMENTS 5,158,489 A * 10/1992 Araki ..... B63C 9/26 441/80
2003/0176123 A1* 9/2003 Schwindt ..... B63C 9/26 441/84
2011/0081814 A1* 4/2011 Yu ..... B63C 9/26 441/80

FOREIGN PATENT DOCUMENTS

WO 2018157186 A1 9/2018

* cited by examiner

*Primary Examiner* — Andrew Polay
(74) *Attorney, Agent, or Firm* — Sughrue Mion, PLLC

(57) ABSTRACT

A deployable conscious or unconscious person-in-the-water rescue apparatus that can be manually or automatically deployed multiple and consecutive times to assist both a rescuer and a person-in-the-water by providing a tethered net that self-deploys in the water and supports the person-in-the-water while being pulled to safety.

13 Claims, 4 Drawing Sheets

PERSON OVERBOARD RETRIEVAL APPARATUS

CROSS REFERENCE TO RELATED APPLICATIONS

The present application is a continuation of PCT/US2022/046512 filed on Oct. 13, 2022 which claims priority to provisional application numbers 63/256,064 filed on Oct. 15, 2021 and 63/308,624 filed on Feb. 10, 2022, the entireties of which are herein incorporated by reference.

BACKGROUND

1. Field

This disclosure relates to water safety and in particular apparatuses and methods to retrieve conscious or unconscious people from the water.

2. Description of Related Art

Addressing a person-in-the-water (e.g., a "man overboard") situation from either a boat, ship, dock, or land, requires the rescuers to think and act quickly and have access to effective and user-friendly safety equipment. Throwing a floatation device to a person-in-the-water helps that person to stay afloat if they are conscious, but may do nothing to help an unconscious or injured person. Retrieval devices can he complicated to deploy properly and can add injuries to the person-in-the-water depending on the design or deployment approach.

For example, the approach in U.S. Pat. No. 6,953,374B1 teaches a net or basket attached to a pole that is used to catch a person-in-the-water. This approach is limited in its range by the length and weight of the pole and can be dangerous for the rescuer when leverage is not in their favor and dangerous for the person-in-the-water because the pole can hit and injure them. U.S. Pat. No. 7,238,074B1 uses a deployed float on one end of a mechanism and requires maneuvering by the boat to surround the person-in-the-water. This requires additional time in a time-critical event, and is not useable from land or ships without access to a maneuverable boat.

SUMMARY

It is an object to provide a portable, repeatedly manual or automatic deployable rescue apparatus that overcomes many of these disadvantages. It is a further object to allow a rescuer to repeatedly deploy a retractable net from any location with little leverage or stability needed to bring a conscious or unconscious person-in-the-water to a desired location. It is another object to provide a repeatedly and easily deployable rescue apparatus that requires a small storage area when not in use.

DETAILED DESCRIPTION OF EMBODIMENTS

Figure 1:
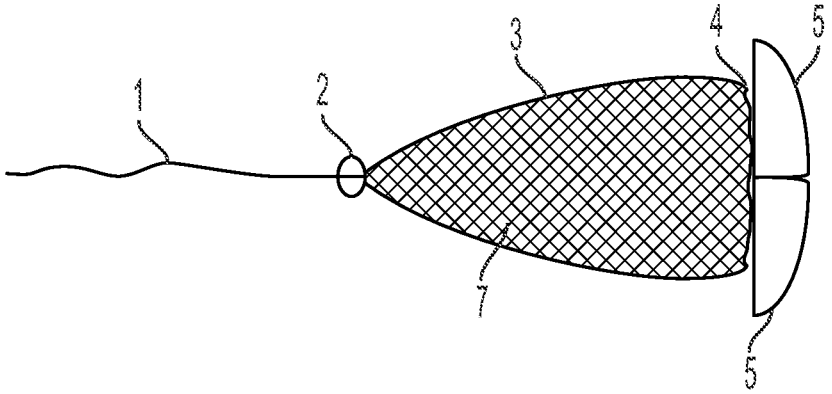
FIG. 1 illustrates a side view of an apparatus according to some embodiments in the stored or not deployed mode according.
Figure 2:
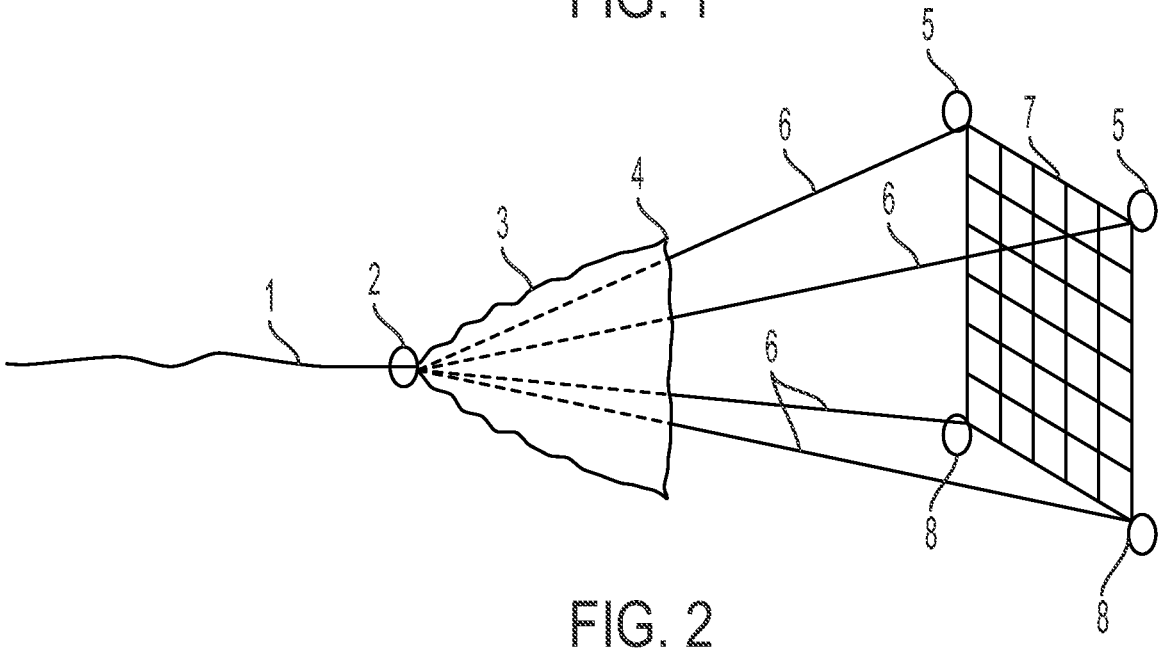
FIG. 2 is a side view of an apparatus after being deployed and pulled, according to some embodiments.
Figure 3:
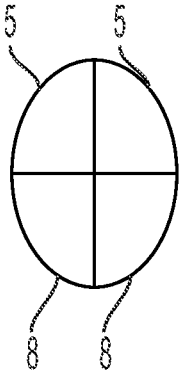
FIG. 3 is the back view of an apparatus in the stored or not deployed mode, according to some embodiments.
Figure 4:
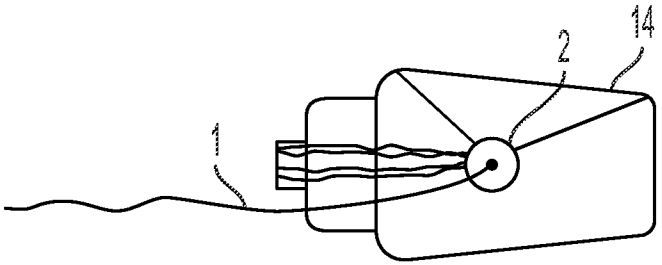
FIG. 4 depicts aspects of embodiments showing the side view not deployed.

As shown in FIGS. 1-3, tether line 1 passes through float 2 and connects to a swivel that is connected to four net lines 6 that pass through planar buoys 5 and connect to net 7. Net 7 has weights 8 on the bottom side to cause it to move in a sinking direction when deployed while the two planar buoys 5 float and move in opposite directions away from each other when tension is applied to tether line 1. In some embodiments, net lines 6 may be substantially identical to each other, weights 8 may be substantially identical to each other, tether line 1 passes through the center of float 2, and planar buoys 5 may be directionally opposite planar buoys, to improve the symmetry of deployment.

As shown in FIG. 1, bag 3 may be used to contain net lines 6 and net 7 with the use of retaining device 4 when in the not-deployed mode. Retaining device 4 may be an elastic band, Velcro band, or other type of snap to cinch enough of bag 3 to keep the net inside during storage and/or during the throwing operation, but release from the force and drag when in the water. In a rescue situation, the apparatus as shown in FIG. 1 can be thrown by a single person standing on land, a pier/dock, or a boat/ship, past the person-in-the-eater while keeping the other end of tether line 1.

Upon impact or deployment in the water past the person-in-the-water, the rescuer retrieves tether line 1 and the drag from weights 8 and buoys 5 cause net 7 to expand. Retaining device 4 may release entirely or may remain around bag 3 while net 7 is be pulled out of bag 3 by the drag on weights 8, buoys 5, and/or net 7. Weights 8 lower the bottom of net 7 while buoys 5 keep the upper side of net 7 at or near the surface and expand the upper side during retrieval, so that net 7 is expanded enough to catch the person-in-the-water as net 7 is pulled by the rescuer to the location of the person-in-the-water and towards the rescuer. Of course in a square or rectangular net 7, the buoys 5 and weights 8 may be located at or near the corners. Likewise, in a circular or oval net 7, the buoys 5 and weights 8 may be located appropriately to accomplish the spreading operation upon deployment.

Figure 5:
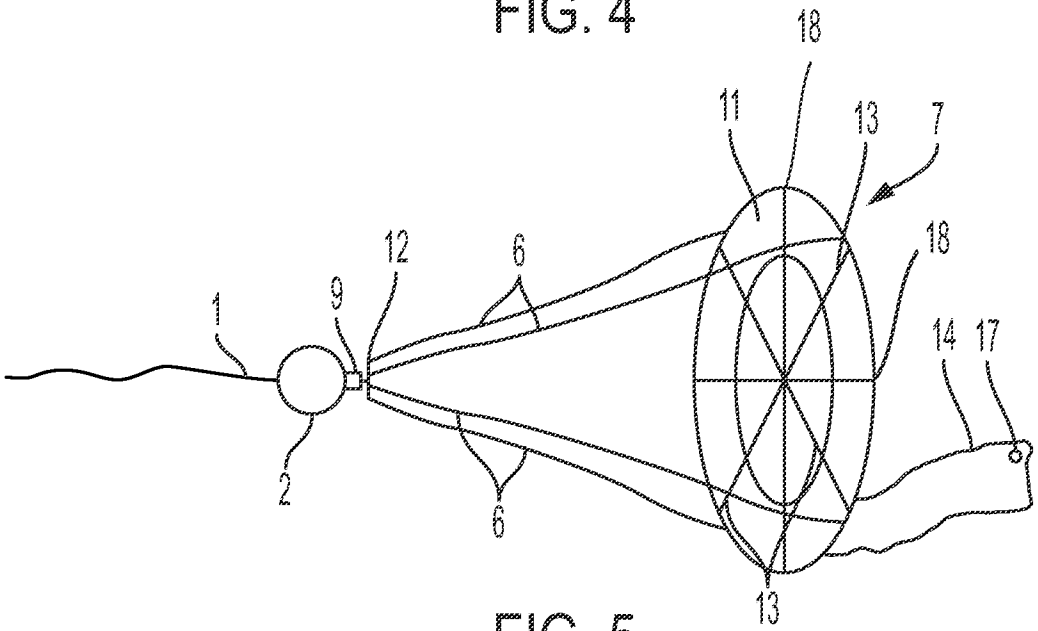
FIG. 5 depicts aspects of embodiments showing the side view deployed.

In some embodiments as shown in FIGS. 4-6B, tether line 1 may pass through float 2 and connect to swivel 9. Swivel 9 connects to lines 6, and may include a spreader plate 12 to assist in spreading lines 6. As shown in FIG. 5, for example, lines 6 connect on the other ends to net 7 or net spreader rods 13 at net 7 that are formed in an X pattern to assist in opening the device during deployment. Net spreader rods 13 may be made of fiberglass or other lightweight material to keep the overall weight down. Net 7 may include one or more support straps 18, which may be a solid fabric or a fabric tube. If fabric tubes are used, then net spreader rods 13 may be slid into support straps 18 to keep them in place.

Some portions of net 7, such as outer portions, may have drag material 11 that has a higher drag coefficient than other portions of net 7, to help create drag that also assists in opening the device when pulled through the water. In some embodiments, drag material 11 may be included around the outer edges of net 7, and/or configured to be shaped in a cone.

Flap 14 may be attached to the back side of one or more of net lines 6 or net 7 and may wrap around all or a substantial portion of the apparatus when not deployed to keep it contained for storage, instead of or in addition to using bag 3. Flap 14 may include a fastener, such as a first snap portion 17, Velcro, or a button, that connects to a corresponding fastener on, for example, swivel 9 or spreader plate 12. Wrapping all or a substantial portion of the apparatus with flap 14 allows the apparatus to be compressed and therefore more easily thrown, and increases the distance and accuracy of the throw as compared to an unwrapped apparatus.

Figure 6A:
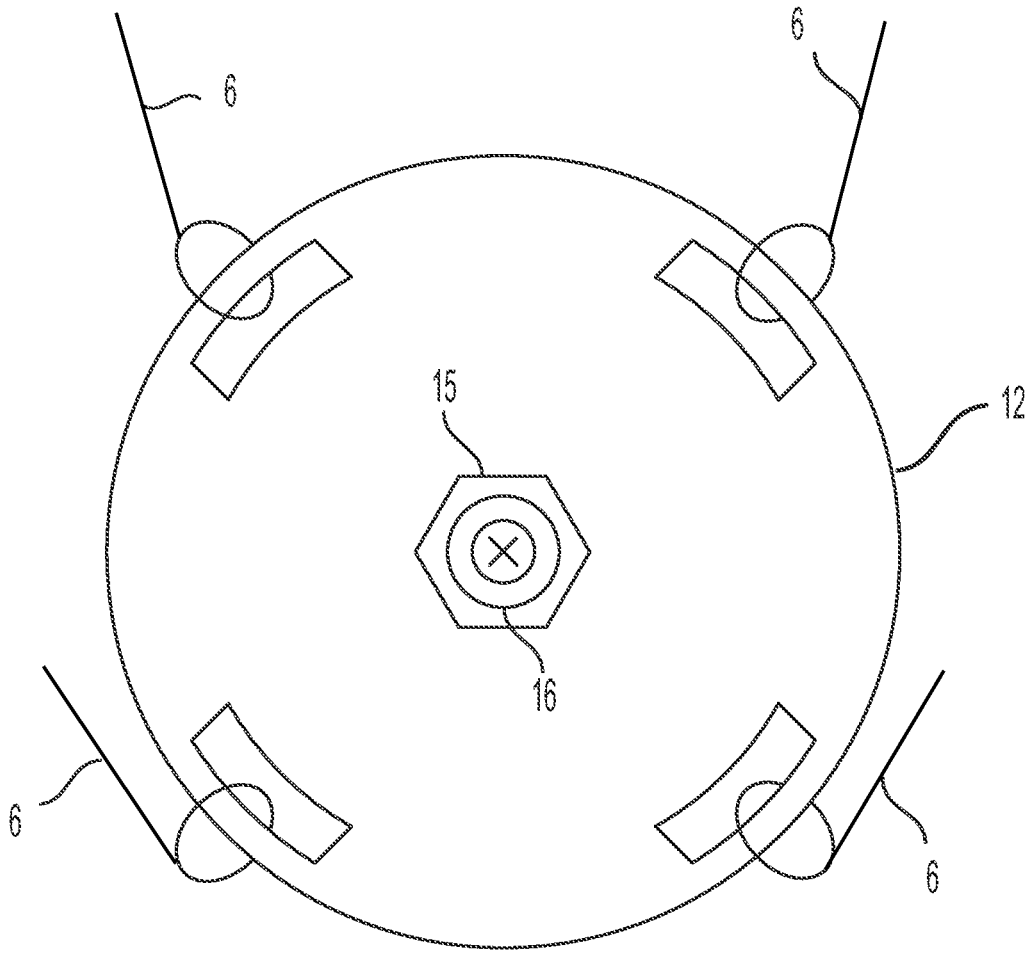
FIG. 6A depicts aspects of embodiments showing a swiveling spreader plate arrangement from a fastener-side view.
Figure 6B:
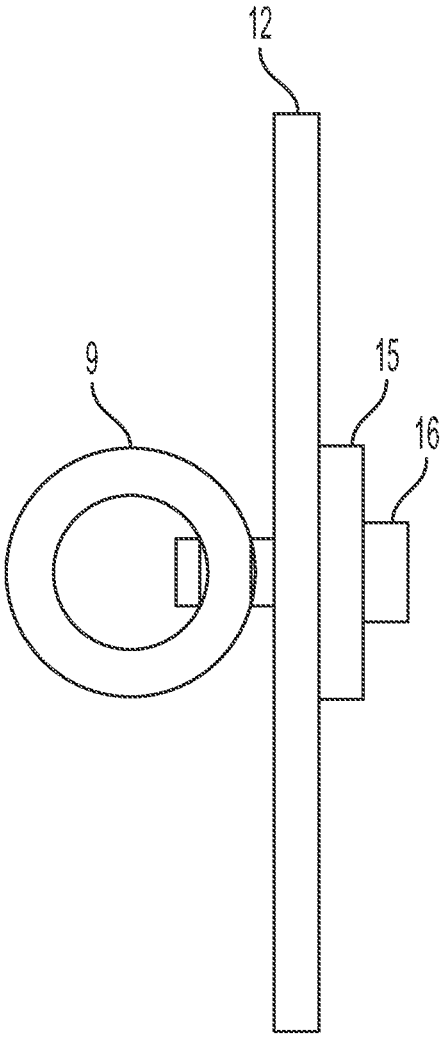
FIG. 6B depicts aspects of embodiments showing a swiveling spreader plate arrangement from a side view.

As shown in FIG. 6B, swivel 9 may include a loop portion for connecting tether line 1, and may be connected to spreader plate 12 for example, by a bolt structure that allows for swivel movement. As shown in FIG. 6A and 6B, on the non-tether line side of spreader plate 12, a nut 15 may be used to secure a bolt bolding swivel 9. Further, in some embodiments a fastener such as second snap portion on 16 may be secured to the bolt or nut 15, so that flap 14 may be fastened to the swivel 9 and spreader plate 12 assembly by connecting first snap portion 17 of the flap 14, to second snap portion 16. In some embodiments, the bolt may be tapped to receive a screw and second snap portion 16 may be screwed into the bolt. Upon deployment, the drag created by the rescuer pulling on tether line 1 and the drag from the apparatus in the water, causes second snap portion 16 and first snap portion 17 to separate, and the apparatus to deploy as shown in FIG. 5.

Aspects of the disclosed embodiments enable a rescuer to manually throw the rescue apparatus past a person-in-the-water, repeatedly if necessary, and as the rescuer pulls on the tether line 1, the apparatus expands to enable catching the conscious or unconscious person-in-the-water and bringing the conscious or unconscious person-in-the-water toward the rescuer.

While this disclosure has described several non-limiting embodiments, there are alterations, permutations, and various substitute equivalents, which fall within the scope of the disclosure. It will thus be appreciated that those skilled in the art will be able to devise numerous apparatuses, devices and methods which, although not explicitly shown or described herein, embody the principles of the disclosure and are thus within the spirit and scope thereof.

What is claimed is:

1. A person-in-the-water rescue apparatus, comprising:

a tether line including a float and swivel near a deployable end, the swivel being connected to first ends of multiple net lines;

a net connected to second ends of the multiple net lines; and net spreader rods attached to the net to help spread the net upon deployment, the net spreader rods being formed in a cross-pattern.

2. The person-in-the-water rescue apparatus according to claim 1, wherein the net spreader rods are fiberglass and formed in an x-pattern.

3. The person-in-the-water rescue apparatus according to claim 1, wherein the net further comprises drag material with a higher drag coefficient than other portions of the net to help spread the net upon deployment.

4. The person-in-the-water rescue apparatus according to claim 1, further comprising:

a flap attached at one end to the net and having a fastener portion at another end, the flap being large enough to wrap a portion of the apparatus and fasten to the swivel for storage and to improve throwing distance and accuracy.

5. The person-in-the-water rescue apparatus according to claim 1, further comprising a spreader plate operationally connected to the swivel, for spreading the net lines.

6. The person-in-the-water rescue apparatus according to claim 1, further comprising:

a flap attached at one end to the apparatus and having a fastener at another end, the flap being large enough to wrap a portion of the apparatus and fasten the another end to the apparatus for storage and to compact the apparatus to improve throwing distance and accuracy at deployment.

7. The person-in-the-water rescue apparatus according to claim 3, wherein the drag material is configured in a conical shape.

8. The person-in-the-water rescue apparatus according to claim 3, wherein the drag material is configured to cause the net to form a conical shape when being retrieved.

9. A person-in-the-water rescue apparatus, comprising:

a tether line including a float and swivel near a deployable end, the swivel being connected to first ends of multiple net lines;

a net connected to second ends of the multiple net lines; and net spreader rods attached to the net to help spread the net upon deployment, wherein the net is configured to form a conical shape when being retrieved.

10. The person-in-the-water rescue apparatus according to claim 1, further comprising:

at least one float connected to an upper side of the net; and at least one weight connected to a lower side of the net than the at least one float.

11. The person-in-the-water rescue apparatus according to claim 10, wherein the multiple net lines include 4 net lines, the at least one float includes 2 floats, and the at least one weight includes 2 weights.

12. The person-in-the-water rescue apparatus according to claim 11, wherein the two floats are directionally opposite planar buoys configured to move away from each other when the tether line is pulled.

13. The person-in-the-water rescue apparatus according to claim 1, wherein the net spreader rods are displaced at least partially inside support straps.

* * * * *